US005768727A

United States Patent [19]

Brainerd

[11] Patent Number: 5,768,727

[45] Date of Patent: Jun. 23, 1998

[54] INTEGRATED MODULAR ICE AXE HEAD

[75] Inventor: Charles Brainerd, Salt Lake City, Utah

[73] Assignee: Black Diamond Equipment, Ltd., Salt Lake City, Utah

[21] Appl. No.: 587,730

[22] Filed: Jan. 19, 1996

[51] Int. Cl.[6] ..... B25D 13/10

[52] U.S. Cl. ..... 7/145; 7/170; 81/20

[58] Field of Search ..... 7/144, 145, 167, 7/170, 118, 143; 76/103, 119, 20, 23; 81/26

[56] References Cited

U.S. PATENT DOCUMENTS

| | | | |
|---|---|---|---|
| 1,041,903 | 10/1912 | Thomas | 81/23 |
| 1,582,305 | 4/1926 | Reichling | 81/20 |
| 2,501,757 | 3/1950 | Cagle | 7/145 |
| 3,824,641 | 7/1974 | Shandel | 7/145 |
| 4,308,628 | 1/1982 | Kunberger et al. | 7/145 |
| 4,476,597 | 10/1984 | Gobbi | 7/170 |
| 5,012,702 | 5/1991 | Taylor | 81/26 |
| 5,297,306 | 3/1994 | Shandel | 7/145 |

FOREIGN PATENT DOCUMENTS

| | | | |
|---|---|---|---|
| 27148 | 12/1905 | United Kingdom | 7/145 |

*Primary Examiner*—D. S. Meislin
*Assistant Examiner*—Joni B. Danganan
*Attorney, Agent, or Firm*—Thorpe, Notth & Western, LLP

[57] ABSTRACT

An integrated modular ice axe head is disclosed including a first base member fixedly attached to a handle and a second base member, attachable to the first base member, which has an accessory, such as a hammer head or adze formed integrally therewith. Preferably, the two base members form a receiving slot when they are attached to one another for receiving and holding the base of an accessory, such as an ice pick. Because the first and second base members can move toward and away from one another before attachment is completed, the receiving slot is of variable width and facilitates pieces having loose tolerances.

25 Claims, 5 Drawing Sheets

INTEGRATED MODULAR ICE AXE HEAD

BACKGROUND OF THE INVENTION

1. Field of the Invention

The present invention relates to a head for ice axes and, in particular, to an integrated modular ice axe head which facilitates the addition and removal of accessories to/from the ice axe head and which provides increased ability to adjust for loose tolerances in the accessories attached to the ice axe head.

2. State of the Art

The popularity of rock and mountain climbing has increased dramatically over the last decade. The availability of equipment which is lighter and stronger than previously available, and the desire to be closer to nature, has lead many people to take up these sports. As these sports have increased in popularity, the deficiencies of many prior art products have become apparent, and efforts have been made to improve the same.

As mountain climbing has increased in popularity, the number of persons encountering climbs which involve ice formations has also increased. To facilitate climbing on ice, new ice axes where developed to better enable the user to make the climb. These ice axes were more versatile than prior axes, were more durable, and were lighter weight.

In FIG. 1A, there is shown a top view of a commonly available axe head, generally indicated at 10. The ice axe head 10 includes an elongate piece of metal 14 which is typically formed of a durable material such as stainless steel or a 4130 Chrome-Molly alloy or aluminum. The ice axe head 10 is attached to a handle 16 which is used by the climber to swing the ice axe head 10 with sufficient force to drive accessories attached to the head into ice formations for support, to dig a foot-hold, or to hammer in an anchor.

At each end 14*a* and 14*b* of the piece of metal 14 is a receiving slot 18 which passes all the way through the piece of metal at the respective end, thereby leaving a pair of opposing sidewalls 22 extending to form each end. Passing through each sidewall 22 is one or more holes 26. One hole 26 adjacent each end 14*a* or 14*b* can be threaded to receive the threads of a bolt which is used to hold accessories within the receiving slots 18 as is shown in FIG. 1B, or a nut can be used on one side to secure the bolt. Typically one end (14*a* in FIG. 1B) of the ice axe head 10 will have an ice pick 30 disposed in the receiving slot 18 so that the ice pick extends outwardly from the handle 16. The ice pick 30 is held in the receiving slot 18 by one or more threaded bolts 34 which pass through the holes 26 (FIG. 1A) and threadedly engages the sides of at least one of the holes or a nut positioned on the opposite side. When the bolt 34 is tightened, the ice pick 30 is pinched between the sidewalls 22 to hold the pick in the appropriate position.

Within the receiving slot 18 defined by the sidewalls 22 of the opposing end 14*b* is the base 40 of an adze 44. Unlike the ice pick 30 which is long and slender, the adze 44 is broad and enables the climber to exploit cracks and crevices in the ice formations and chop ice. The base 40 of the adze 44 is held securely within the receiving slot 18 in the end 14*b* by a bolt 48.

An advantage of the configuration of FIGS. 1A and 1B is that the accessories can be changed. For example, in FIG. 1C there is shown a side view of the ice axe head 10 shown in FIGS. 1A and 1B, and the ice pick 30 shown in FIG. 1B. On an opposite end of the piece of metal 14 forming the head 10, a hammer head 52 is disposed so that its base 56 extends into the receiving slot 18, where it is secured by bolt 48. While the hammer head 52 is not as useful as the adze for exploiting cracks in the ice formation, it is superior to either the adze or the ice pick for pounding security devices into the ice or adjacent rocks.

One major problem that is present in the prior art devices shown is that the heads are difficult to form properly. If the receiving slots 18 are too wide, it is difficult to secure the bases of accessories such as the hammer head, the adze and the ice pick. If the receiving slots 18 are too narrow, the bases will not fit between the sidewalls 22 forming the receiving slots. Manufactures make several picks, adzes and hammer heads which a climber may desire to use, and it is important that the hammer head will accommodate the different bases of the accessories. Additionally, accessories wear out and break with use.

Numerous different approaches are currently being used to form the ice axe heads to achieve the proper receiving slot size. Several companies use forging, while others stamp the heads or machine the off-sets. Still other companies cast the heads. Each of these methods is expensive and has achieved less than the desired result. Thus, there is a need for a integrated modular ice axe head which simplifies manufacture and which will allow tolerances.

SUMMARY OF THE INVENTION

It is an object of the present invention to provide an improved axe head which provides a greater range of tolerances for the bases of ice axe head accessories, while securely holding each accessory mounted therein.

It is another object of the present invention to provide an ice axe head which may be completely disassembled and reassembled.

It is still another object of the present invention to provide such an ice axe head wherein at least one of the accessories is formed integrally with a portion of the head.

It is yet another object of the present invention to provide such an ice axe head wherein the width of the receiving slots are variable so as to accommodate accessories having bases with loose tolerances.

It is a further object of the present invention to provide such an ice axe head that is inexpensive and easy to manufacture.

The above and other objects of the invention are realized in specific illustrative embodiments of an integrated modular ice axe head including a first base member which is fixedly attached to a handle by which the base member may be swung. A second base member is provided which is attachable to the first base member by bolts or other convenient, secure attaching mechanisms. At a first end, at least one of the first and second base members has an off-set portion formed therein. The second base member is attached to the first base member so that the at least one off-set portion forms a receiving slot.

In accordance with one aspect of the invention, the first base member has an off-set portion disposed in the first end, and the second base member has a off-set portion which is a mirror image of that in the first base member so that the two off-set portions together form a receiving slot which accommodates the bases or attachment sections of different accessories.

In accordance with another aspect of the invention, a hammer is attached to or otherwise formed integrally with an opposing second end of either the first or second base such that when the first and second base members are attached together, the hammer is already disposed at the end of the ice axe head opposite the receiving slot. Preferably, the hammer is formed as a single unit with the second, attachable base member so that attachment of the second base member automatically attaches the hammer, but also enables the attachment of other accessories.

In accordance with a further aspect of the present invention, an adze is attached to or otherwise formed integrally with the second end of the first or second base member so that the adze is already disposed in place when the first and second base members are attached together. Preferably, the adze will be formed integrally with the second, attachable base member so that attachment of the second base member to the first base member automatically attaches and positions the adze with respect to the ice axe head and the handle which is attached thereto.

In accordance with still another aspect of the present invention, the first base member or second base member includes one or more ribs disposed in the off-set portion so as to help maintain the proper orientation for accessories placed therein.

In accordance with yet another aspect of the present invention, the distance between the first and second base members when they are secured together may be varied so as to vary the width of the receiving slot. This is due to the fact that only the first base member is fixedly attached to a handle, thereby permitting adjustment in the position of the second base member along bolts which connect the first and second base members. By enabling the receiving slot to be widened or narrowed, the base members enable the use of accessories, such as ice picks, which do not fall within the conventional range acceptable by the prior art ice axe heads.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the appended claims.

Figure 1A:
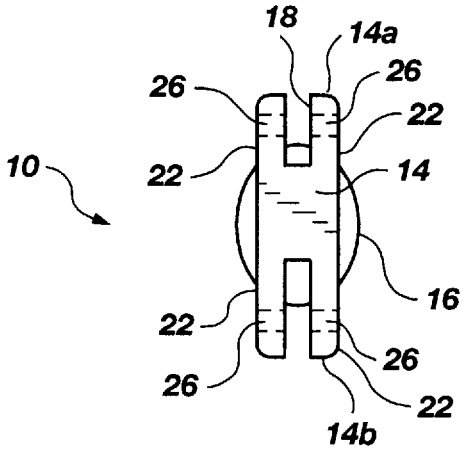
Fig. 1A (PRIOR ART)
FIG. 1A shows a top view of an ice axe head made in accordance with the teachings of the prior art.
Figure 1B:
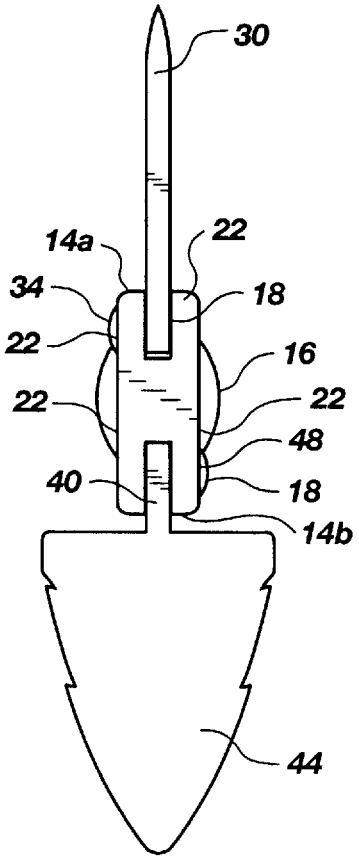
Fig. 1B (PRIOR ART)
FIG. 1B shows a top view of the ice axe head of FIG. 1, with an ice pick and adze attached to the head in accordance with the prior art.
Figure 1C:
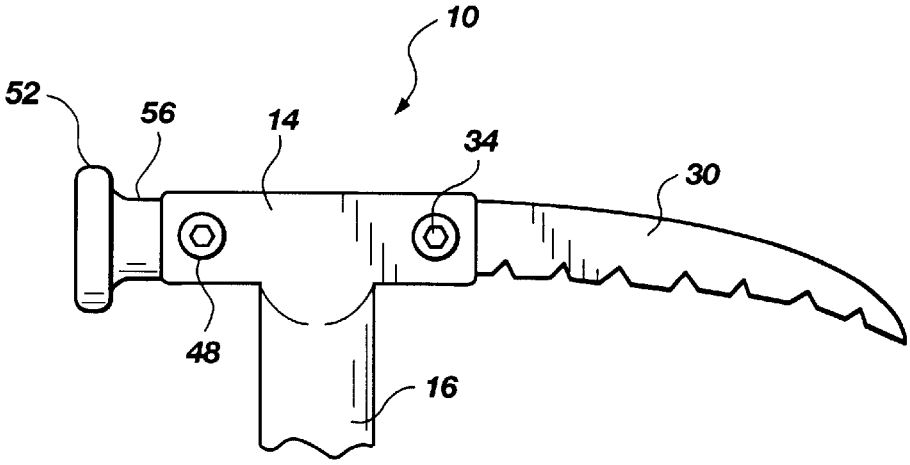
Fig. 1C (PRIOR ART)
FIG. 1C shows a side view of the ice axe head of FIG. 1 with an ice pick and a hammer head attached to the ice axe head in accordance with the prior art.
Figure 2:
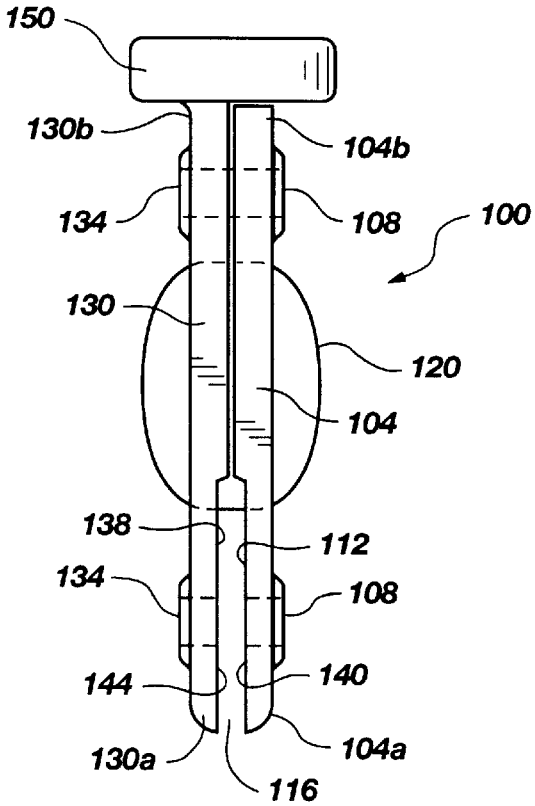
FIG. 2 shows a top view of an integrated modular ice axe head made in accordance with the teachings of the present invention.

Referring to FIG. 2, there is shown a top view of an integrated modular ice axe head, generally indicated at 100. The head includes a first base member 104 having a first end 104*a* and a second end 104*b*. Adjacent each end 104*a* and 104*b* are holes 108 drilled or formed through the base member 104 so that a bolt or other securing device (not shown) may be passed therethrough.

At the first end 104*a*, an off-set portion 112 is formed in the base member 104. As will be explained in additional detail below, the off-set portion 112 forms a receiving slot 116 for holding accessories (not shown in FIG. 2) to the ice axe head 100. The accessory is held in place by bolts (not shown) which extend through the hole 108 in the first end 104*a*.

The first base member 104 is fixedly attached to a handle 120. Typically, the first base member 104 is riveted, pinned and/or glued to the handle. However, the base member 104 could be formed integrally with the handle 120, or could be attached in some other way. The handle 120 can be of any type currently used for ice axes, or those to be developed in the future.

Also shown in FIG. 2 is a second base member 130 which is not fixedly attached to the handle 120. The second base member 130 has a first end 130*a* and a second end 130*b* disposed opposite one another. Each end has holes 134 which can be aligned with the respective holes 108 in the first and second ends 104*a* and 104*b*, respectively, of the first base member 104. When bolts are secured through the holes 108 and 134 at each end of the first and second base members 104 and 130, respectively, the two base members are held together to form the modular ice axe head 100.

As with the first base member 104, the second base member 130 has a off-set portion 138 formed therein at the first end 130*a*. The off-set portion 138 is a mirror image of the off-set set portion 112 disposed at the first end 104*a* of the first base member 104 so that the two off-set portions form the receiving slot 116 for receiving the base of an accessory such as an ice pick (not shown in FIG. 2). The accessory is secured in the receiving slot 116 by passing a bolt through the holes 108 and 134 in the first end 104*a* and 130*a* of each base member 104 and 130, respectively. Typically, one of the holes 108 or 134 will be threaded to engage the bolt and hold it in place, or a nut can be provided at the far end of the bolt.

While shown in FIG. 2 as having an off-set portion in each base member 104 and 130, those skilled in the art will appreciate that the off-set portion 112 or the off-set portion 138 could be enlarged, thereby removing the need for an off-set portion in the opposing base member. However, to achieve such, the end of the base member 104 or 130 in which the off-set portion were placed would need to be thick enough to provide adequate support.

One significant advantage of the present invention is that the width of the receiving slot 116, i.e. the distance between the first end 104*a* of the first base 104 and the first end 130*a* of the second base 130, can be changed. Because the second base member 130 can move relative to the first base member 104, the inner sides 140 and 144 of the ends 104*a* and 130*a* formed by the off-sets 112 and 138 are brought into contact with the sidewalls (not shown) of the base of the accessory, instead of being fixed as are those of the prior art. If the accessory's base is narrower than conventional tolerances, the inner sides 140 and 144 are brought closer together. If the accessory's base is wider than conventional tolerances, such as would not fit in a conventional ice axe head, the inner sides 140 and 144 are merely disposed slightly farther apart. The bolts are then anchored in the holes 108 and 134 to hold the second base member 130 to the first base member 104, thereby holding the base of the accessory securely in place between the base members.

Disposed at the opposing second end 130*b* of the second base member 130 is a hammer head 150. The hammer head 150 is disposed integrally with the second base member 130, such as by casting or forging, or is attached thereto by welding or some other attachment method. By having the hammer head 150 disposed integrally with the second base member 130 facilitates rapid assembly or disassembly of the modular ice axe head 100, as the user need not worry about positioning the base of the hammer head within a receiving slot. The integral formation of the hammer head 150 and the second base member 130 also reduces the number of parts in the assembly. An additional advantage is that the hammer head 150 is effectively stronger as it is bolted directly to the first base member 104 via the second base member 130, rather than merely pinched therebetween.

Figure 2A:
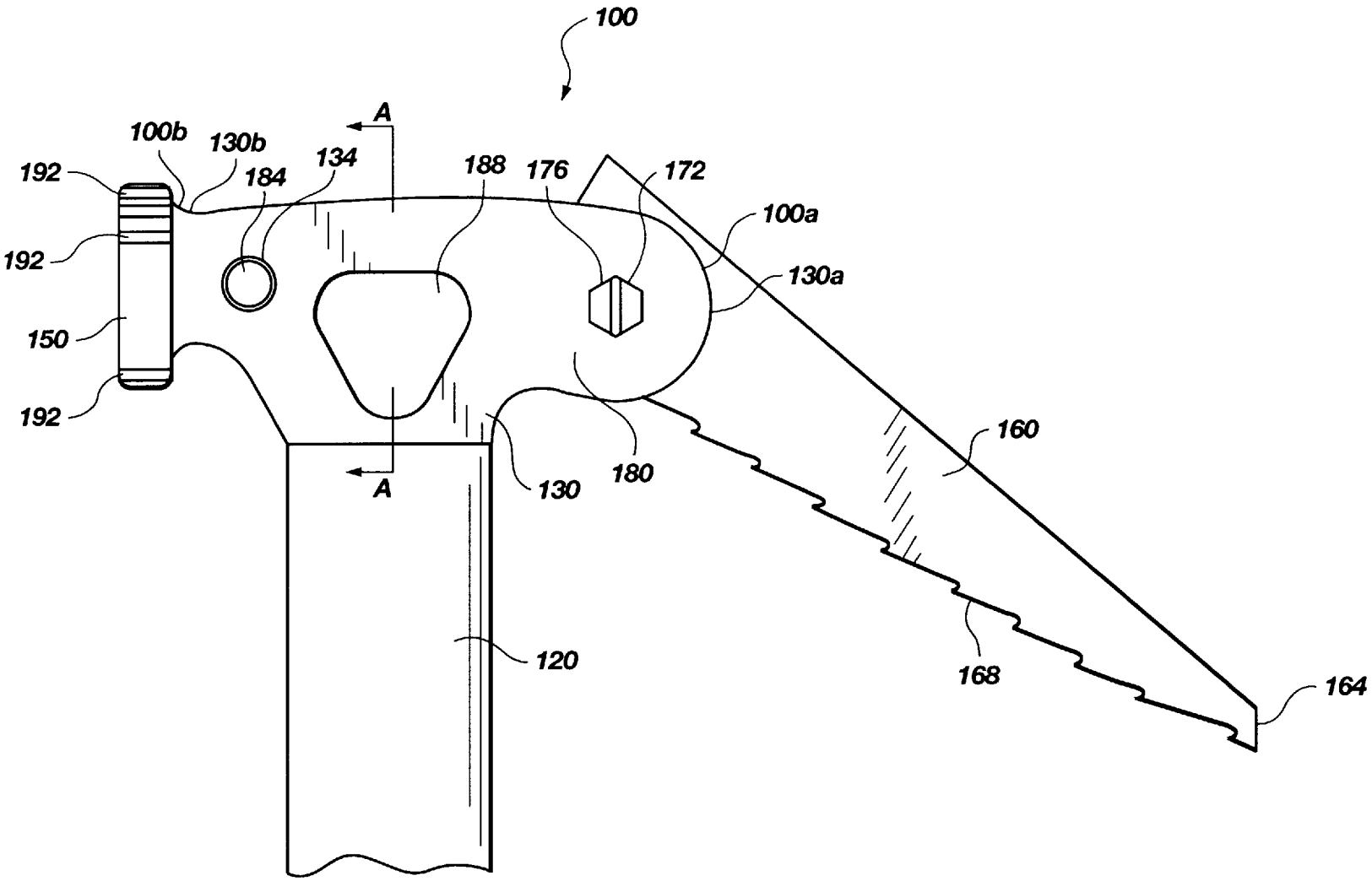
FIG. 2A shows a side view of the integrated modular ice axe head of FIG. 2.

Referring now to FIG. 2A, there is shown a side view of the integrated ice axe head 100 of FIG. 2, with an ice pick 160 disposed therein. The ice pick 160 is disposed to extend from a first end 100*a* of the integrated modular head 100, formed by the first ends 104*a* (FIG. 2) and 130*a* of the base members 104 and 130. Because of the side view, only the second, attachable base 130 is seen in FIG. 2A.

The ice pick 160 extends outwardly and downwardly from the ice axe head 100 so that pulling the handle away from an ice formation into which the pick has been forced, will secure the end 164 of the pick within the ice. The pick 160 also has a serrated underside 168 which helps the user securely hold his or her position on various ice formations.

The ice pick 160 is held between the first and second base members 104 and 130. The base members 104 and 130 are connected by bolts 172 with its head 176 disposed on the outside of one of the base members and an opposing end (not shown) either threadedly engaging the other base member, or being engaged with a nut disposed on the outside of the opposing base member.

If a different ice pick is desired, i.e. one of a different size or different shape, the user need only remove the bolt 172, slide the pick 160 out of the receiving slot 116 (FIG. 2), place the new pick in the receiving slot, and then reattached the bolt. Thus, within a minute a pick can be replaced with an alternate. Because the base members 104 and 130 can be moved with respect to one another when the bolts are not in place, the user need not worry that the base 180 of the pick 160 will be too narrow or too wide. Rather, if the base is wider than conventional tolerances, the bolt 172 will fasten with less rotation, and if the base 180 is thinner than conventional tolerances, additional rotations of the bolt will pull the base members together to hold the pick in place.

The first and second base members 104 and 130 are also attached by a second bolt 184 adjacent a second end 100*b* of the modular ice axe head 100. The placement of the bolts 172 and 184 at opposing ends 100*a* and 100*b* provides a move secure attachment between the two base members 104 and 130, preventing rotation of one base member (typically the second base member) relative to the other.

Formed in each base member 104 and 130 between the holes 108 or 134 is a void 188. The void 188 is formed in each base member 104 and 130 to reduce the overall weight of the ice axe handle 100; to provide a hole to tie a webbing wrist leash and/or to provide a place into which a carabiner may be clipped. Those skilled in the art will appreciate that unnecessary additional weight can cause the climber to tire more rapidly and can negatively effect the likelihood of success during the climb.

Also shown in FIG. 2A are a plurality of off-sets 192 formed in the hammer head 150. As will be explained in additional detail with respect to FIG. 2B, the off-sets 192 enable the hammer head 150 to be used in crevices and cracks more effectively to aid climbing.

Figure 2B:
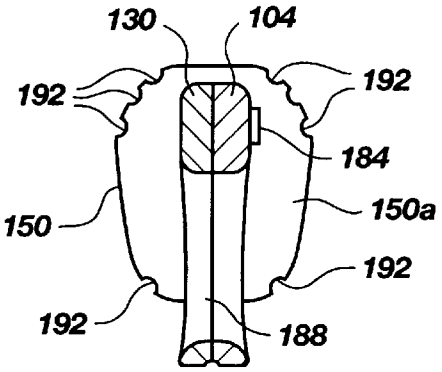
FIG. 2B shows a cross-sectional view of the ice axe head of FIG. 2A taken along the line A—A.

Referring now to FIG. 2B, there is shown a cross-sectional view of the first and second base members 104 and 130, respectively, taken along the line A—A. The view shows the void 188 and the bolt 184 used to hold together the second end 104*b* and 130*b* of the base members. Also shown is a backside 150*a* of the hammer head 150.

A plurality of grooves 192 are formed in the hammer head 150 adjacent the corners. The grooves 192 are used to engage the rock and prevent the hammer head 150 from slipping from crevices and cracks in rock formations when the hammer head 150 is being used as an anchoring device to steady the climber.

As was shown in FIG. 2, the hammer head 150 is connected to the second base member 130, but is not connected to the first base member 104—which is fixedly attached to the handle 120 (not shown in FIG. 2B). Thus, if the user decides to replace the hammer head 150, the bolts 172 (FIG. 2A) and 184 are loosened sufficiently that the second base member 130 and the hammer head 150 can be pulled away from the first base member 104, and then replaced with a new second base member having a different hammer head or some other accessory formed integrally therewith.

Figure 3:
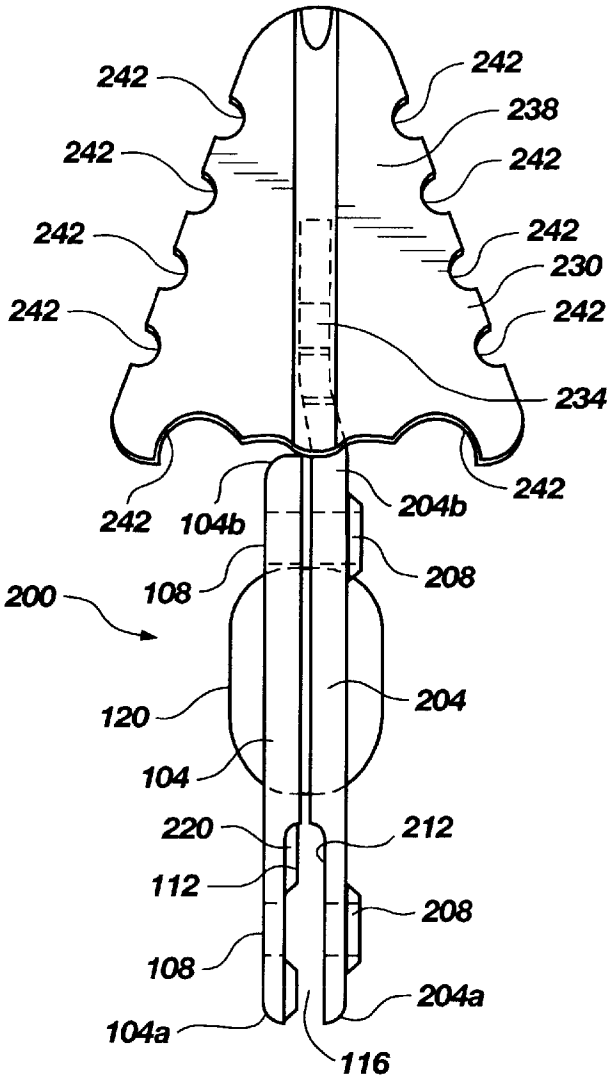
FIG. 3 shows a top view of another embodiment of an integrated modular ice axe head made in accordance with the teachings of the present invention.

FIG. 3 shows an alternate embodiment of the integrated modular ice axe head 200 of the present invention. The embodiment includes a first base member 104 which is substantially the same as the first base member 104 in FIGS. 2–2B. The only real difference between the first base member of FIG. 3 and that shown in FIGS. 2–2B is that the base member 104 in FIG. 3 is disposed left of center on the handle, whereas the base shown in FIGS. 2–2B is disposed right of center. Those skilled in the art will appreciate that it is not important which side of the handle 120 the first, fixedly attached base member 104 is disposed upon. Because the first base member 104 of FIG. 3 is substantially identical in all other ways, the different portions of the base member shall be given like numeral indications as those provided in FIGS. 2–2B.

The first base member 104 has first and second ends 104*a* and 104*b*, and a hole 108 formed adjacent each end which can be used to attach the first base member 104 to other structures. Adjacent the first end 104*a*, the first base member 104 has a step or off-set portion 112 formed therein for forming a receiving slot 116, in the manner discussed with respect to FIGS. 2–2B.

The first base member 104 is fixedly attached to the handle 120 which is used to swing the axe head 200. The handle 120 may be made of wood, metal, composites, or a combination of materials.

The second base member 204 has first and second ends 204*a* and 204*b*, respectively. The first end 204*a* has off-set portion 212 formed therein so as to form a mirror image of the off-set portion 112 in the first base member 104, thereby forming the receiving slot 116. Unlike the embodiment shown in FIGS. 2–2B, a small rib 220 is disposed to stick out into the receiving slot 116. The purpose of the rib is to align and secure rotationally the accessory that is positioned in slot 116 and attached to the ice axe head 200.

Connected to a second end 204*b* of the second base member 204 is an adze 230. Adzes are used to cut into ice formations to form toe-holds, to exploit cracks and crevices in the ice, and otherwise assist the climber in securing his or her position while climbing the ice. An arm 234 is used to attach the adze to the second end 204*b* of the second base member 204. Typically, the arm 234 will be formed integrally with the second base member 204.

Attached to the arm and extending outwardly therefrom is a curved, generally triangular shaped cutting member 238. A plurality of notches 242 are formed in the cutting member about its periphery. The notches 242 help the user to chop holes into ice formations and to wedge the adze into crevices as the user climbs. Those skilled in the art will appreciate that adzes come in a large variety of shapes and sizes, any of which may be used with the present invention.

Once bolts (not shown in FIG. 3) are disposed in the holes 108 and 208 to hold the first base member 104 and the second base member 204 together, the adze 230 is more securely held to the handle 120 than many conventional adzes. Additionally, the adze 230 can be quickly replaced with another adze, with a hammer head, or with some other modular accessory integrated with a "second" base member.

Figure 3A:
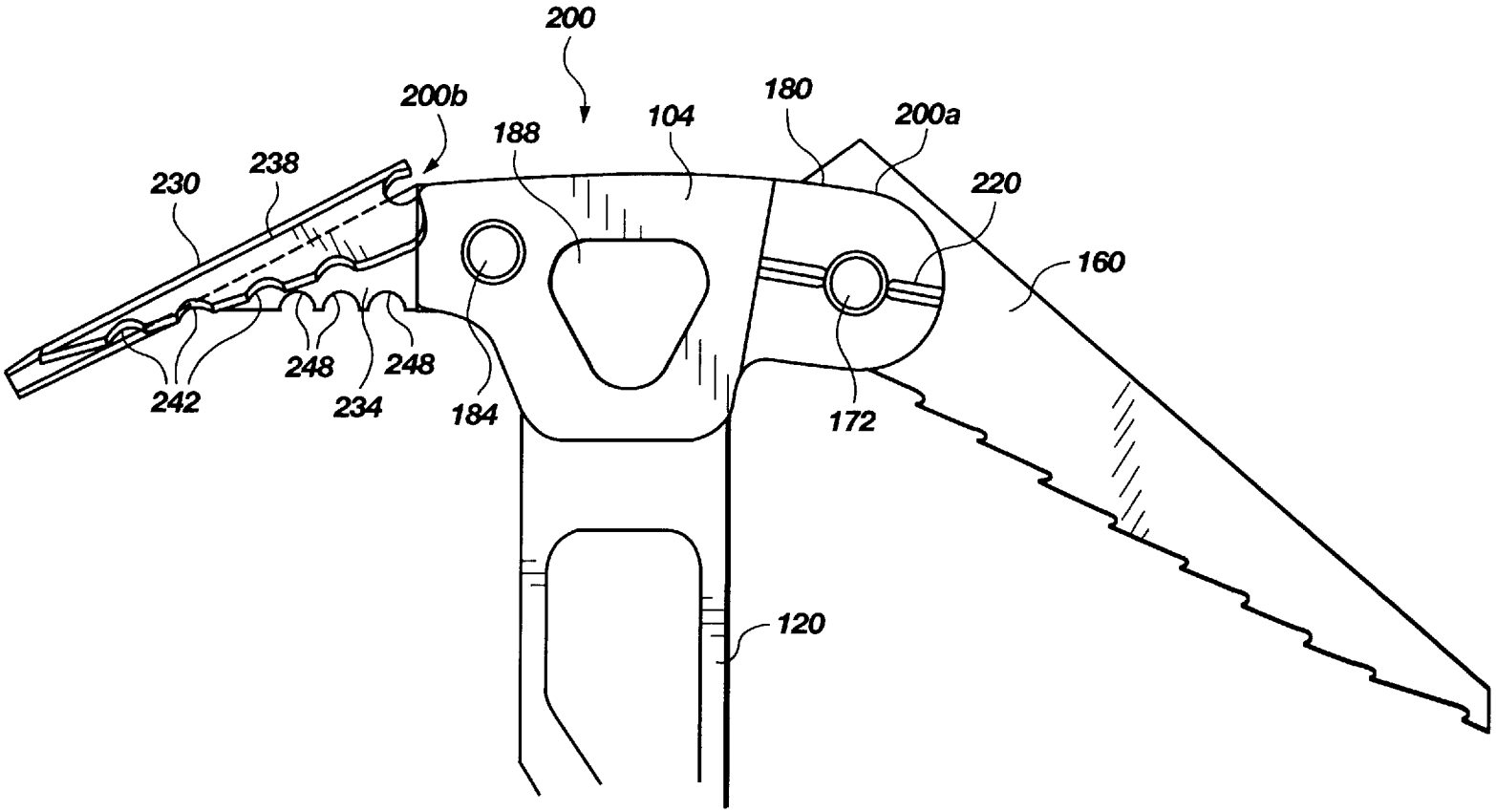
FIG. 3A shows a side view of the integrated modular ice axe head of FIG. 3.

Referring now to FIG. 3A, there is shown a side view of the integrated modular ice axe handle 200 of FIG. 3. The first base member 104 is attached to the handle 120 (only a fragmented view of which is shown). At the first end 200*a* a bolt 172 is used to hold the first and second base members 104 and 204 together and to hold the base 180 of the ice pick 160 firmly between the base members.

Another bolt 184 is used at a second end 200*b* on the integrated modular ice axe head 200 to provide additional support. The view in FIG. 3A shows the end of each bolt to demonstrate that the direction of the bolts is not critical. The void 188 in each of the base members 104 and 204 is disposed between the two bolts.

At the opposing second end 200*b*, the adze 230 is attached to the second base member 204 (FIG. 3) by the arm 234. The triangular cutting member 238 curves down so as to cover part of the arm 234. Just as the triangular cutting member 238 has notches 242 formed therein, a plurality of notches 248 are disposed on the underside of the arm 234 to provide additional mechanisms for gripping ice. Of course, the adze 230 shown could be replaced with any of the adzes which are currently available.

While advantages are obtained for the user of the present invention, namely ease of assembly and disassembly and greater tolerances, the most significant advantage gained by the present invention is the ease of manufacture. Forming an attachable base member with an adze, hammer head or other ice axe accessory formed integrally therewith significantly decreases the cost of manufacture, as no complex casting or forging is required. Additionally, because the hammer head, adze or other accessory is formed integrally with the attachable second base, additional strength is provided to the over all ice axe head.

Thus there is disclosed an improved integrated modular ice axe handle which implements the objects of the present invention. Those skilled in the art will recognize numerous modifications which can be made without departing from the scope or spirit of the application. For example, the ice pick could be formed integrally with one of the base members. The appended claims are intended to cover such modifications.

What is claimed is:

1. An integrated modular ice axe comprising:

an elongate handle;

a first base member fixedly attached to the handle, the base member having first and second ends;

a second base member releasably attached to the first base member, the second base member comprising first and second ends and a tool head disposed so as to extend from the second end, the second base member being configured so that when the second base member is attached to the first base member, the first end of the second base member is disposed adjacent to the first end of the first base member, and the second end of the second base member is disposed adjacent to the second end of the second base member;

attachment means for securely connecting the second base member to the first base member;

at least one off-set portion formed in at least one of the first ends of the first and second base members so as to form a receiving slot when the first and second base members are connected; and an ice pick disposable within the receiving slot.

2. The integrated modular ice axe of claim 1, wherein the at least one off-set portion comprises an off-set portion disposed at the first end of the first base member.

3. The integrated modular ice axe of claim 2, wherein the at least one off-set portion comprises an off-set portion disposed at the first end of the second base member and positioned so that when the second base member is connected to the first base member, the off-set portion at the first end of the first base member and the off-set portion at the first end of the second base member form the receiving slot for an tool head.

4. The integrated modular ice axe of claim 3, wherein the tool head extending from the second end of the second base member is a hammer head.

5. The integrated modular ice axe of claim 3, wherein the tool head extending from the second end of the second base member is an adze.

6. The integrated modular ice axe of claim 3, further comprising a rib disposed on at least one of the base members so as to extend into the receiving slot.

7. The integrated modular ice axe of claim 1, wherein the tool head comprises a hammer head.

8. The integrated modular ice axe of claim 7, wherein the second base member and the hammer head are formed from a single piece of metal.

9. The integrated modular ice axe of claim 1, wherein the tool head comprises an adze having a triangular cutting member and the second base member includes an arm for attaching the cutting member to the second end of the second base member.

10. The integrated modular ice axe of claim 9, wherein the arm for attaching the cutting member to the second end of the second base member and the second base member are formed of a single piece of metal.

11. The integrated modular ice axe of claim 1, wherein the second base member has an off-set portion formed at the first end thereof.

12. The integrated modular ice axe of claim 11, wherein the first base member has an off-set portion formed at the first end thereof and disposed so as to be positioned adjacent the off-set portion of the second base member when the first and second base members are attached to one another.

13. The integrated modular ice axe head of claim 1, wherein the first and second base members each have a hole formed therein adjacent respective first ends and adjacent respective second ends and disposed such that when the first and second base members are disposed adjacent each other to form the receiving slot, each hole in the first base member is aligned with a hole in the second base member.

14. The integrated modular ice axe of claim 13, wherein the attachment means comprises a plurality of bolts disposable through said plurality of holes.

15. The integrated modular ice axe of claim 13, wherein the holes formed adjacent the first end of the first and second base members form a means for attaching the ice pick to the first and second base members.

16. An integrated modular tool comprising:

an elongate handle;

a first base member fixedly attached to the handle, the base member having first and second ends, an off-set portion being disposed in the first end;

a second base member releasably attachable to the first base member, the second base member comprising first and second ends within off-set portion formed in the first end such that when the first and second base members are attached to one another, the off-set portions in the first and second base members form a receiving slot for releasably receiving a tool head;

a hammer head formed integrally with the second base member at the second end; and an attachment means for selectively holding the second base member to the first base member.

17. An integrated modular ice axe comprising;

an elongate handle;

a first base member fixedly attached to the handle, the base member having first and second ends, an off-set portion being disposed in the first end;

a second base member releasably attachable to the first base member, the second base member comprising first and second ends with an off-set portion formed in the first end such that when the first and second base members are attached to one another, the off-sets in the first and second base members form a receiving slot;

an adze head formed integrally with the second base member at the second end of said second base member;

an attachment means for selectively holding the second base member to the first base member; and an ice pick disposable within the receiving slot.

18. A method for forming an integrated modular ice axe comprising:

a) selecting a handle having a first base member with an off-set portion formed in one end of the base member fixedly attached thereto;

b) selecting a second base member which is attachable to the first base member and which has a tool head selected from the group consisting of a hammer head, an adze and an ice pick formed integrally therewith;

c) attaching the second base member to the first base member so as to form a receiving slot between the first and second base members to enable releasable attachment of a tool head while the first and second base members remain attached; and d) selecting a tool head for disposition in the slot, the tool head being selected from the group consisting of a hammer head, an adze and an ice pick.

19. The method of claim 18, wherein step (a) comprises, more specifically, selecting a handle having a first base member with first and second ends fixedly attached thereto, the first base member having an off-set portion formed at the first end thereof.

20. The method of claim 19, wherein step (b) comprises, more specifically, selecting a second base member having an adze formed integrally therewith, and step comprises as selecting a tool head which is an ice pick.

21. The method of claim 18, wherein step (b) comprises, more specifically, selecting a second base member having first and second ends and an off-set portion positioned in the first end.

22. The method of claim 21, wherein step (c) comprises, more specifically, attaching the second base member to the first base member so as to form a receiving slot between the first and second base members.

23. The method of claim 18, wherein step (b) comprises, more specifically, selecting a second base member having a hammer head formed integrally therewith, and step (d) comprised as selecting a tool head which is an ice pick.

24. An integrated modular tool comprising;

an elongate handle;

a first base member fixedly attached to the handle, the base member having first and second ends;

a second base member releasably attachable to the first base member, the second base member comprising first and second ends and a tool head disposed so as to extend from the second end, the first and second ends of the second base member being alignable with the first and second ends of the first base member;

attachment means for securely connecting the second base member to the first base member; and at least one off-set portion formed in at least one of the first ends of the first and second base members so as to form a hollow receiving slot when the first and second base members are connected, the receiving slot being formed between the first end of the first base member and the first end of the second base member, and configured for releasably receiving a second tool head while the first and second base members are attached.

25. An integrated modular ice axe head, comprising:

a first base member fixedly mountable to a handle, the base member having a first end and a second end;

a second base member releasably attached to the first base member and having a first end and a second end, the first end of the second base member being disposed proximate to the first end of the first base member and forming a receiving slot there between;

a tool head integrated with and extending from the second end of the second base member; and an ice pick disposable in the receiving slot.

* * * * *